US012428817B2

(12) United States Patent
Nakajima et al.

(10) Patent No.: US 12,428,817 B2
(45) Date of Patent: Sep. 30, 2025

(54) HYDRAULIC CIRCUIT OF A CONSTRUCTION MACHINERY

(71) Applicant: Caterpillar SARL, Geneva (CH)

(72) Inventors: Hideki Nakajima, Akashi (JP); Koichi Kiyasu, Akashi (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 18/947,197

(22) Filed: Nov. 14, 2024

(65) Prior Publication Data

US 2025/0154745 A1 May 15, 2025

(30) Foreign Application Priority Data

Nov. 15, 2023 (JP) ..... 2023-194147

(51) Int. Cl.
*E02F 9/22* (2006.01)

(52) U.S. Cl.
CPC ..... *E02F 9/2296* (2013.01); *E02F 9/2242* (2013.01); *E02F 9/2253* (2013.01); *E02F 9/2292* (2013.01)

(58) Field of Classification Search
CPC ..... E02F 9/2239; E02F 9/2242; E02F 9/2253; E02F 9/2292; E02F 9/2296; F15B 11/17
USPC ..... 60/421, 422, 429
See application file for complete search history.

(56) References Cited

U.S. PATENT DOCUMENTS

| | | | | |
|---|---|---|---|---|
| 5,361,211 | A * | 11/1994 | Lee | F15B 11/05 701/50 |
| 5,829,252 | A * | 11/1998 | Hirata | E02F 9/2242 60/429 |
| 7,559,197 | B2 * | 7/2009 | Verkuilen | F15B 21/087 60/429 |
| 8,607,557 | B2 * | 12/2013 | Ikeda | E02F 9/2242 60/471 |
| 9,562,345 | B2 * | 2/2017 | Lee | E02F 9/2242 |
| 11,542,963 | B2 * | 1/2023 | Ueda | E02F 9/2285 |
| 12,180,682 | B2 * | 12/2024 | Nakajima | E02F 9/2296 |
| 12,312,773 | B2 * | 5/2025 | Nishikawara | E02F 9/2282 |
| 2006/0265915 | A1 * | 11/2006 | Toji | E02F 9/2296 37/348 |

FOREIGN PATENT DOCUMENTS

JP 2017020604 A 1/2017

* cited by examiner

*Primary Examiner* — Michael Leslie

(57) ABSTRACT

Problem: Provide a hydraulic circuit of a construction machinery that can effectively use the excess flow rate of the first hydraulic pump. Solution: In the hydraulic circuit, when signals are output from the first travel operator, the second travel operator, and the actuator operator, hydraulic oil is supplied from the first hydraulic pump to the actuator switch valve. Hydraulic oil is also supplied from the second hydraulic pump to the first travel switch valve and the second travel switch valve. Further, according to the signal output from the actuator operator, the opening degree of the communication valve is adjusted to control the supply amount of hydraulic oil sent from the first pump line to the second pump line.

12 Claims, 6 Drawing Sheets

HYDRAULIC CIRCUIT OF A CONSTRUCTION MACHINERY

CROSS-REFERENCE TO RELATED APPLICATION

This application claims priority under 35 USC § 119 and the Paris Convention to Japanese Patent Application 2023-194147 filed on Nov. 15, 2023.

TECHNICAL FIELD

The present invention relates to a hydraulic circuit of a construction machinery for supplying hydraulic oil to a first travel motor, a second travel motor and other hydraulic actuator.

BACKGROUND

A hydraulic excavator, which is a representative example of a construction machinery, includes a lower travel body, an upper revolving body rotatably supported on an upper portion of the lower travel body, and a front work machine mounted on the upper revolving body. The lower travel body includes a left and right pair of tracks, a first travel motor that drives one track, and a second travel motor that drives the other track.

In general, in the hydraulic circuit of a hydraulic excavator, hydraulic oil is supplied to a hydraulic actuator from two or more hydraulic pumps. For example, if an operation of straight travel is performed, hydraulic oil is supplied from the first hydraulic pump to the first travel motor, and hydraulic oil is supplied from the second hydraulic pump to the second travel motor. In addition, when the operation of straight travel and the operation of the front work machine are performed simultaneously, hydraulic oil is supplied from the first hydraulic pump to the hydraulic actuator that operates the front work machine, and the same amount of hydraulic oil is supplied from the second hydraulic pump to both the first and second travel motors. This ensures straightness when driving (see, for example, Patent Document 1).

PRIOR ART DOCUMENTS

Patent Document

Patent Document 1: JP 2017-20604 A

SUMMARY OF THE INVENTION

Problems to be Solved by the Invention

When an operation of straight travel and an operation of a front work machine are carried out at the same time, there may be a surplus in the supply flow rate of the first hydraulic pump due to the operating speed of the front work machine. However, this excess flow was wasted without being used.

An object of the present invention is to provide a hydraulic circuit of a construction machinery that can effectively use an excess flow rate of a first hydraulic pump.

Means for Solving the Problem

The present invention provides a hydraulic circuit of a construction machinery as follows to solve the above problem. That is, the present invention provides:

"A hydraulic circuit of a construction machinery for supplying hydraulic oil to a first travel motor, a second travel motor and other hydraulic actuator, the hydraulic circuit comprising:

a capacity-variable first hydraulic pump, a capacity-variable second hydraulic pump, a first pump line in which hydraulic oil discharged from the first hydraulic pump flows, a second pump line in which hydraulic oil discharged from the second hydraulic pump flows, a first travel switch valve connected to the first pump line and the second pump line and configured to switch a flow direction of hydraulic oil relative to the first travel motor, a second travel switch valve connected to the second pump line and configured to switch a flow direction of hydraulic oil relative to the second travel motor, an actuator switch valve connected to at least the first pump line and configured to switch a flow direction of hydraulic oil relative to the other hydraulic actuator, a first open-close valve provided between the first hydraulic pump and the first travel switch valve, a second open-close valve provided between the second hydraulic pump and the first travel switch valve, a communication line connecting the first pump line and the second pump line, a communication valve provided in the communication line, a first travel operator configured to output a signal for operating the first travel motor, a second travel operator configured to output a signal for operating the second travel motor, an actuator operator configured to output a signal for operating the other hydraulic actuator, and a controller that performs circuit control based on signals output from the first travel operator, the second travel operator, and the actuator operator, wherein the controller:

opens the first open-close valve and closes the second open-close valve when a signal is output from the first travel operator and/or the second travel operator and no signal is output from the actuator operator, thereby causing the first hydraulic pump to supply hydraulic oil to the first travel switch valve and/or causing the second hydraulic pump to supply hydraulic oil to the second travel switch valve and closing the communication valve; and on the other hand, when signals are output from the first travel operator, the second travel operator, and the actuator operator, causes hydraulic oil to be supplied from the first hydraulic pump to the actuator switch valve, and by closing the first open-close valve and opening the second open-close valve, causes hydraulic oil to be supplied from the second hydraulic pump to the first travel switch valve and the second travel switch valve, and at the same time, adjusts an opening degree of the communication valve in response to the signal output from the actuator operator to control an amount of hydraulic oil supplied from the first pump line to the second pump line."

Preferably, the controller, when a signal is output from the first travel operator, the second travel operator, and the actuator operator, causes an opening degree of the communication valve to be a first opening degree when the signal output from the actuator operator is less than a predetermined value, and a second opening degree that is less than the first opening degree when the signal output from the actuator operator is greater than or equal to the predetermined value.

It is desirable that the first opening degree is set to an opening degree such that a rotational speed of the first travel motor is not less than a required speed in accordance with an operating amount of the first travel operator and a rotational speed of the second travel motor is not less than a required speed in accordance with an operation amount of the second travel operator. The first opening degree may be changed according to a signal of the actuator operator.

The second opening degree is preferably set to an opening degree such that an actuation speed of the other hydraulic actuator is not less than a required speed according to an operation amount of the actuator operator. The second opening degree may be changed according to a signal of the actuator operator. The second opening may be fully closed.

When the opening degree of the communication valve is set to the first opening degree, it is advantageous for the controller to reduce the discharge amount of the second hydraulic pump to the extent that, the rotational speed of the first travel motor is not lower than a required speed according to an operation amount of the first travel operator and the rotational speed of the second travel motor is not lower than a required speed according to an operation amount of the second travel operator.

The communication valve has a backflow prevention function that permits a flow of hydraulic oil from the first pump line to the second pump line, but can prevent a backflow from the second pump line to the first pump line.

The actuator switch valve is connected to both the first pump line and the second pump line, a check valve is provided between the actuator switch valve and the first hydraulic pump, and a flow control valve may be provided between the actuator switch valve and the second hydraulic pump.

Preferably, the actuator switch valve is connected to both the first pump line and the second pump line, a flow control valve is provided between the actuator switch valve and the first hydraulic pump, and a poppet valve is provided between the actuator switch valve and the second hydraulic pump.

The actuator switch valve may be connected to the first pump line but not connected to the second hydraulic pump line, and a check valve may be provided between the actuator switch valve and the first hydraulic pump.

Effect of the Invention

In the hydraulic circuit of the construction machinery of the present invention, when signals are respectively output from the first and second travel operators and the actuator operator, the excess flow rate of the first hydraulic pump is used to operate the first and second travel motors because it causes the hydraulic oil to be supplied from the first hydraulic pump to the actuator switch valve and the hydraulic oil to be supplied from the second hydraulic pump to the first and second travel switch valves, and at the same time, controls the amount of hydraulic oil supplied from the first pump line to the second pump line. Thus, according to the present invention, the excess flow rate of the first hydraulic pump can be effectively used.

EMBODIMENTS FOR IMPLEMENTING THE INVENTION

Now, embodiments of the hydraulic circuit of the construction machinery according to the present invention will be described with reference to the drawings above.

Hydraulic Circuit 2

Figure 1:
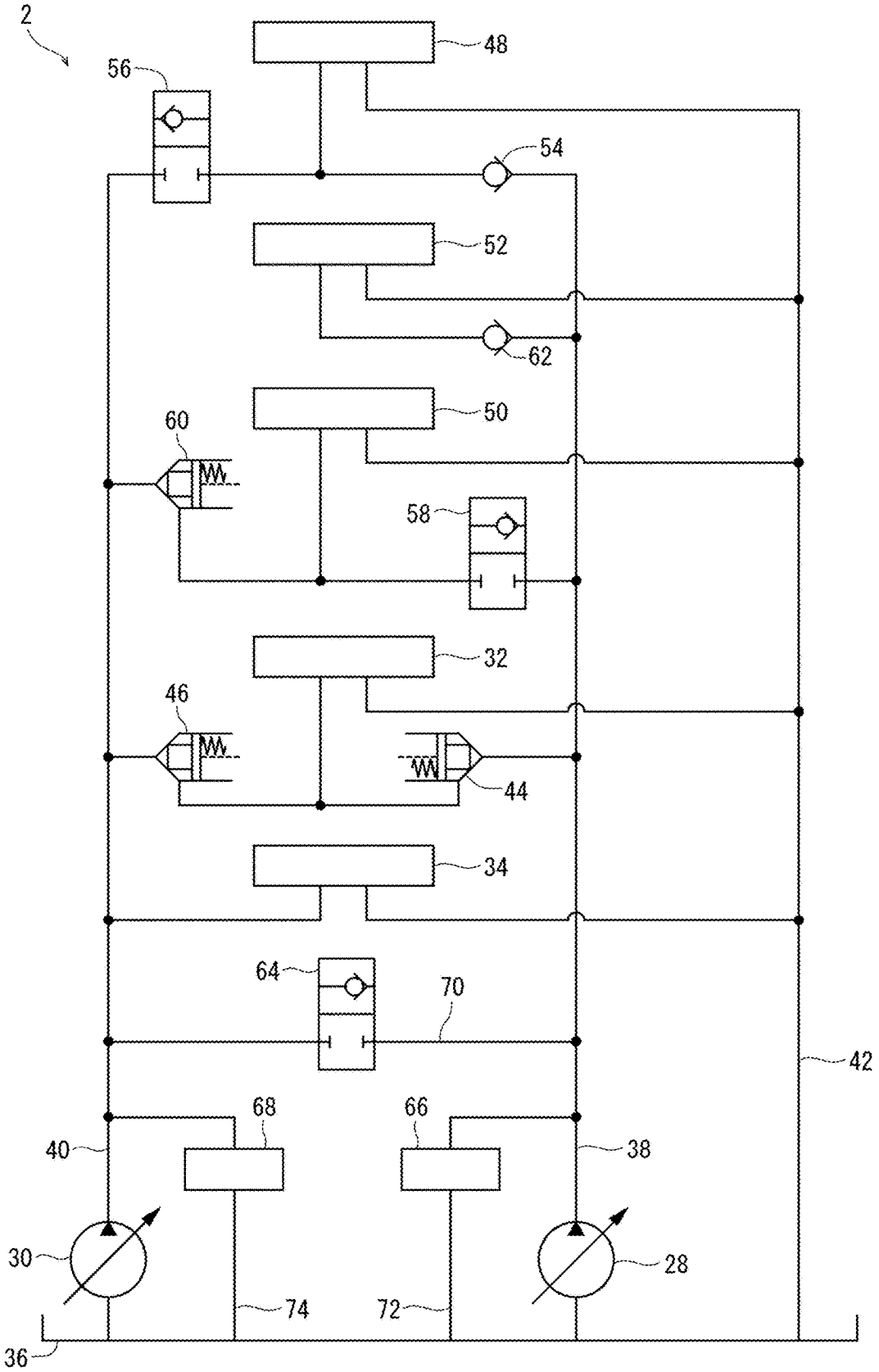
FIG. 1 is a circuit diagram of a hydraulic circuit of a construction machinery according to the present invention.

The hydraulic circuit 2 shown in FIG. 1 is an example of a hydraulic circuit according to the present invention and is mounted on a self-propelled construction machinery. The hydraulic circuit 2 is a circuit for supplying hydraulic oil to a first travel motor, a second travel motor, and other hydraulic actuator other than the first and second travel motors.

Figure 2:
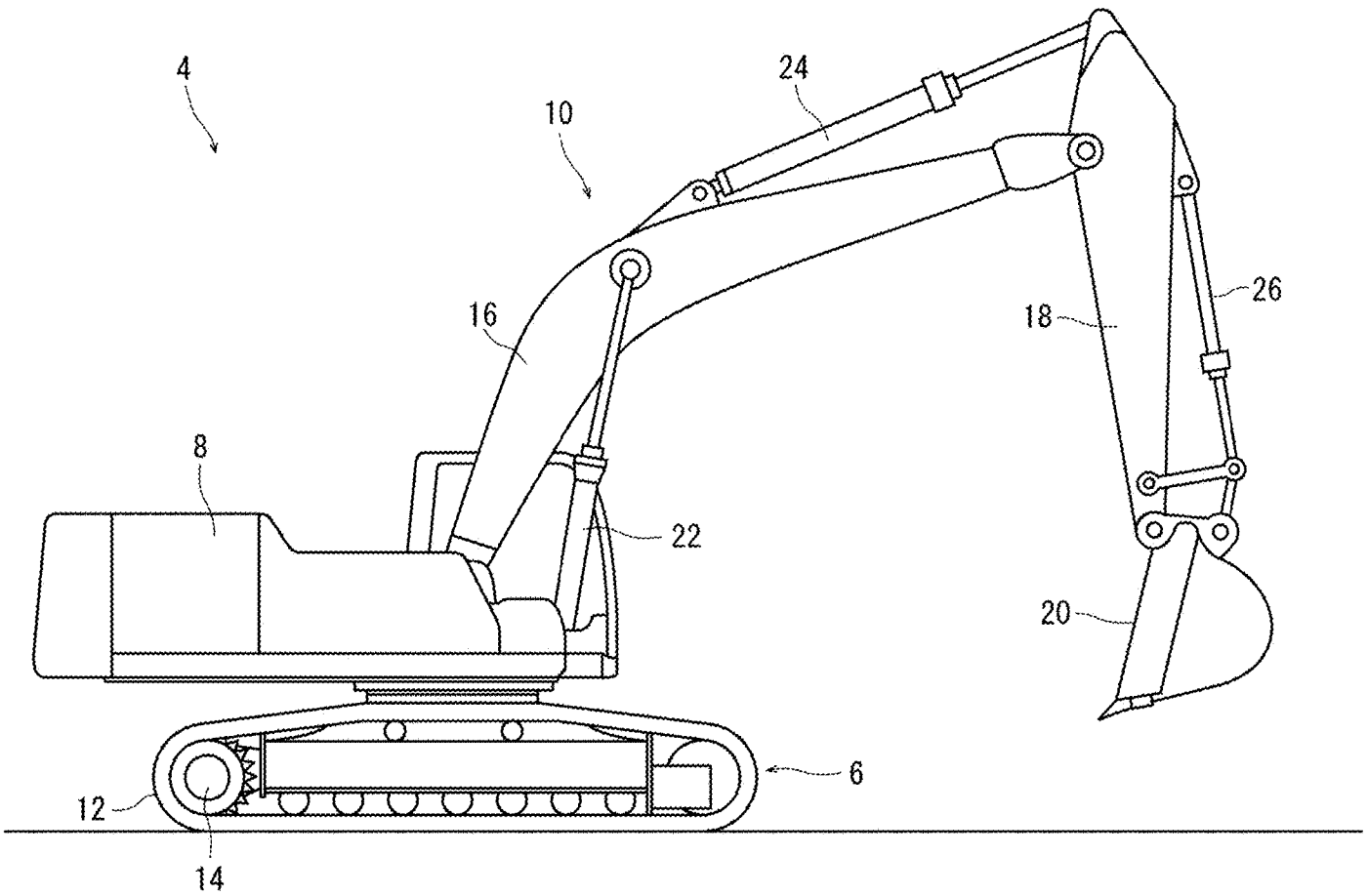
FIG. 2 is a side view of a hydraulic excavator.

The hydraulic circuit 2 may be mounted on the hydraulic excavator 4 shown in FIG. 2, for example. The hydraulic excavator 4 is provided with a lower travel body 6, an upper revolving body 8 rotatably supported by the lower travel body 6, and a front work machine 10 mounted on the upper revolving body 8. The lower travel body 6 includes a pair of tracks 12 (only one side is illustrated.), a first travel motor 14 that drives one track 12, and a second travel motor (not shown) that drives the other track. The front work machine 10 includes a boom 16 that is swingably supported by the upper revolving body 8, an arm 18 that is swingably supported by a tip of the boom 16, a bucket 20 that is swingably supported by a tip of the arm 18, a boom cylinder 22 that swings the boom 16, an arm cylinder 24 that swings the arm 18, and a bucket cylinder 26 that swings the bucket 20.

If the hydraulic circuit 2 is mounted on the hydraulic excavator 4 shown in FIG. 2, at least one of the boom cylinder 22, the arm cylinder 24, and the bucket cylinder 26 may correspond to the other hydraulic actuator described above. However, the other hydraulic actuator described above are not limited to at least one of the boom cylinder 22, the arm cylinder 24, the bucket cylinder 26, and may be other hydraulic actuator (e.g., a revolving motor that revolves the upper revolving body 8).

The hydraulic circuit 2 is described with reference to FIG. 1. The hydraulic circuit 2 comprises a first hydraulic pump 28, a second hydraulic pump 30, a first travel switch valve 32, a second travel switch valve 34, and an actuator switch valve.

First and Second Hydraulic Pumps 28 and 30

The first and second hydraulic pumps 28, 30 are in a variable capacity mode and are driven by a drive source (not shown), such as an engine or an electric motor. The first hydraulic pump 28 discharges hydraulic oil sucked from a tank 36 to a first pump line 38. On the other hand, the second hydraulic pump 30 discharges hydraulic oil sucked from the tank 36 to a second pump line 40. Note that the hydraulic circuit 2 may be provided with a hydraulic pump other than the first and second hydraulic pumps 28 and 30.

First Travel Switch Valve 32

The first travel switch valve 32 controls a direction of rotation of the first travel motor 14 by switching a direction of flow of hydraulic oil relative to the first travel motor 14. The first travel switch valve 32 also controls an amount of hydraulic oil supplied to the first travel motor 14 and controls an amount of hydraulic oil guided from the first travel motor 14 to the tank 36 via a discharge line 42. The first travel switch valve 32 is in an electromagnetic proportional or hydraulic pilot type. The first travel switch valve 32 is connected to both the first and second pump lines 38, 40. However, the first travel switch valve 32 is supplied with hydraulic oil from any of the first and second hydraulic pumps 28, 30 as will be described later.

Second Travel Switch Valve 34

The second travel switch valve 34 controls a direction of rotation of the second travel motor by switching a direction of flow of hydraulic oil relative to the second travel motor. The second travel switch valve 34 also controls an amount of hydraulic oil supplied to the second travel motor and controls an amount of hydraulic oil guided from the second travel motor to the tank 36 via the discharge line 42. The second travel switch valve 34 is in an electromagnetic proportional or hydraulic pilot type, similar to the first travel switch valve 32. The second travel switch valve 34 is connected to the second pump line 40 but not to the first pump line 38. Thus, to the second travel switch valve 34, hydraulic oil is supplied from the second hydraulic pump 30, but no hydraulic oil is supplied from the first hydraulic pump 28.

In FIG. 1, a pair of pipelines connecting the first travel switch valve 32 and the first travel motor 14 and a pair of pipelines connecting the second travel switch valve 34 and the second travel motor are omitted for convenience.

First and Second Open-Close Valves 44, 46

The first and second open-close valves 44, 46 are provided on an upstream side of the first travel switch valve 32. Specifically, the first open-close valve 44 is provided between the first hydraulic pump 28 and the first travel switch valve 32. The second open-close valve 46 is provided between the second hydraulic pump 30 and the first travel switch valve 32. Note that an open-close valve is not provided on an upstream side of the second travel switch valve 34.

In the present embodiment, poppet valves are used as the first and second open-close valves 44, 46. As used herein, a poppet valve is one that can be switched to three states, an open state, a closed state, and a check state, by adjusting the pilot pressure acting on the spring chamber. In the open state, an upstream side (pump side) and a downstream side of the poppet valve are communicated, and in the closed state, the upstream and downstream sides of the poppet valve are blocked. Also, in the checked state, the flow from the upstream side to the downstream side of the poppet valve is allowed, but the backflow from the downstream side to the upstream side of the poppet valve is prevented. Note that the first and second open-close valves 44, 46 may be electromagnetic or hydraulic piloted two-position closing valves having an open position and a closed position.

Actuator Switch Valve

The actuator switch valve is connected to at least the first hydraulic pump 28 and controls an actuation direction of the other hydraulic actuator by switching a flow direction of the hydraulic oil relative to the other hydraulic actuator. In the present embodiment, three of a boom switch valve 48, an arm switch valve 50, and a bucket switch valve 52 are provided as the actuator switch valves. However, the actuator switch valve of the present invention is not limited to at least one of the boom switch valve 48, the arm switch valve 50, and the bucket switch valve 52, and may be other actuator switch valve.

Boom Switch Valve 48

The boom switch valve 48 controls an actuation direction of the boom cylinder 22 by switching a flow direction of the hydraulic oil relative to the boom cylinder 22. The boom switch valve 48 is in an electromagnetic proportional or hydraulic pilot type. As shown in FIG. 1, the boom switch valve 48 is connected to both the first and second pump lines 38, 40. In the present embodiment, a boom check valve 54 is provided between the boom switch valve 48 and the first hydraulic pump 28. The boom check valve 54 prevents a backflow from the boom switch valve 48 to the first hydraulic pump 28. On the other hand, a boom flow control valve 56 is provided between the boom switch valve 48 and the second hydraulic pump 30. The boom flow control valve 56 is electromagnetically proportional and adjusts an amount of hydraulic oil supplied to the boom switch valve 48 from the second hydraulic pump 30. In addition, the boom flow control valve 56 has a backflow prevention function to prevent a backflow from the boom switch valve 48 to the second hydraulic pump 30.

To the boom switch valve 48, hydraulic oil discharged from the first hydraulic pump 28 is supplied via the boom check valve 54, and at the same time, hydraulic oil discharged from the second hydraulic pump 30 is supplied via the boom flow control valve 56, if necessary. The flow rate of the hydraulic oil supplied from the second hydraulic pump 30 to the boom switch valve 48 is adjusted by the boom flow control valve 56. The boom switch valve 48 is configured to control a total flow supplied to the boom switch valve 48 and send it to the boom cylinder 22. The boom switch valve 48 also controls an amount of hydraulic oil discharged from the boom cylinder 22 to the tank 36 via the discharge line 42.

Arm Switch Valve 50

The arm switch valve 50 controls an actuation direction of the arm cylinder 24 by switching a flow direction of hydraulic oil relative to the arm cylinder 24. The arm switch valve 50 is in an electromagnetic proportional or hydraulic pilot type. As shown in FIG. 1, the arm switch valve 50 is connected to both the first and second hydraulic pumps 28, 30. An arm flow control valve 58 is provided between the arm switch valve 50 and the first hydraulic pump 28. The arm flow control valve 58 is electromagnetically proportional and adjusts an amount of hydraulic oil supplied to the arm switch valve 50 from the first hydraulic pump 28. In addition, the arm flow control valve 58 has a backflow prevention function to prevent a backflow from the arm switch valve 50 to the first hydraulic pump 28.

Also, an arm poppet valve 60 is provided between the arm switch valve 50 and the second hydraulic pump 30. The arm poppet valve 60, like the poppet valve described above, is switchable into three states: an open state, a closed state, and a check state. Specifically, when the arm poppet valve 60 is in the open state, the second hydraulic pump 30 and the arm switch valve 50 are communicated, and when the arm poppet valve 60 is in the closed state, the line connecting the second hydraulic pump 30 and the arm switch valve 50 is blocked. Also, when the arm poppet valve 60 is in the checked state, a flow from the second hydraulic pump 30 to the arm switch valve 50 is allowed, but a backflow from the arm switch valve 50 to the second hydraulic pump 30 is prevented.

To the arm switch valve 50, hydraulic oil discharged from the second hydraulic pump 30 is supplied via the arm poppet valve 60 and, if necessary, the hydraulic oil discharged from the first hydraulic pump 28 is supplied via the arm flow control valve 58. The flow rate of the hydraulic oil supplied from the first hydraulic pump 28 to the arm switch valve 50 is adjusted by the arm flow control valve 58. The arm switch valve 50 is configured to control the total flow supplied to the arm switch valve 50 and send it to the arm cylinder 24. The arm switch valve 50 also controls a discharge amount of hydraulic oil guided from the arm cylinder 24 to the tank 36 via the discharge line 42.

Bucket Switch Valve 52

The bucket switch valve 52 controls an actuation direction of the bucket cylinder 26 by switching a flow direction of hydraulic oil relative to the bucket cylinder 26. The bucket switch valve 52 also controls an amount of hydraulic oil supplied to the bucket cylinder 26 and controls an amount of hydraulic oil guided from the bucket cylinder 26 to the tank 36 via the discharge line 42. The bucket switch valve 52 is in an electromagnetic proportional or hydraulic pilot type. As shown in FIG. 1, the bucket switch valve 52 is connected to the first pump line 38 but not to the second pump line 40. A bucket check valve 62 is provided between the bucket switch valve 52 and the first hydraulic pump 28. The bucket check valve 62 prevents a backflow from the bucket switch valve 52 to the first hydraulic pump 28.

For convenience, in FIG. 1, a pair of pipelines connecting the boom switch valve 48 and the boom cylinder 22, a pair of pipelines connecting the arm switch valve 50 and the arm cylinder 24, and a pair of pipelines connecting the bucket switch valve 52 and the bucket cylinder 26 are omitted.

The hydraulic circuit 2 also comprises a communication valve 64, a first bypass valve 66 and a second bypass valve 68.

Communication Valve 64

The communication valve 64 is provided in a communication line 70 that communicates the first pump line 38 and the second pump line 40. The valve 64 is electromagnetically proportional and adjusts the amount of hydraulic oil supplied from the first pump line 38 to the second pump line 40. The communication valve 64 also has a backflow prevention function to allow a flow from the first pump line 38 to the second pump line 40, but to prevent a backflow from the second pump line 40 to the first pump line 38.

First Bypass Valve 66

The first bypass valve 66 is provided in a first bypass line 72 that branches from the first pump line 38 and extends to the tank 36. The first bypass valve 66 is electromagnetically proportional and adjusts an amount of hydraulic oil returning from the first pump line 38 to the tank 36.

Second Bypass Valve 68

The second bypass valve 68 is provided in a second bypass line 74 that branches from the second pump line 40 and extends to the tank 36. The second bypass valve 68 is electromagnetically proportional and adjusts an amount of hydraulic oil returning from the second pump line 40 to the tank 36.

Figure 3:
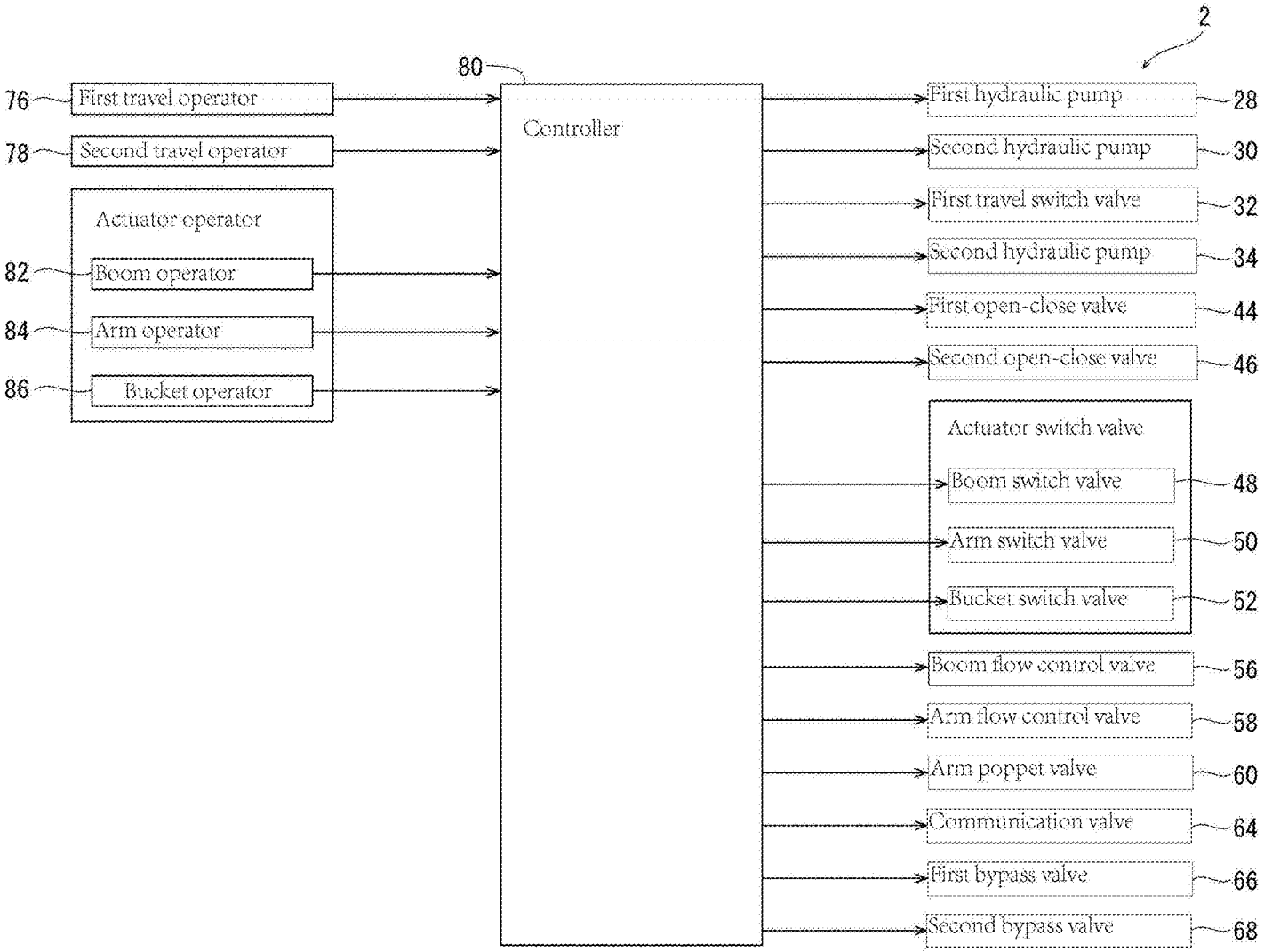
FIG. 3 is a block diagram illustrating the control of controller.

Referring to FIG. 3, the hydraulic circuit 2 further comprises a first travel operator 76, a second travel operator 78, an actuator operator, and a controller 80.

First and Second Travel Operators 76, 78

The first travel operator 76 outputs a signal for actuating the first travel motor 14. The second travel operator 78 outputs a signal for actuating the second travel motor. In the present embodiment, a boom operator 82, an arm operator 84, and a bucket operator 86 are provided as actuator operators. The boom operator 82 outputs a signal for actuating the boom cylinder 22. The arm operator 84 outputs a signal for actuating the arm cylinder 24. The bucket operator 86 outputs a signal for actuating the bucket cylinder 26. Note that the actuator operator is not limited to the boom operator 82, the arm operator 84, and the bucket operator 86.

Each of the operators 76, 78, 82, 84, and 86 may be configured to include an input device (for example, a lever operable in a front-rear direction, a joystick operable in a cross direction, a slide switch, a pedal, etc.) that increases the intensity of a signal output as the operation amount increases. The signals output from each of the operators 76, 78, 82, 84, 86 are electrical or hydraulic signals. The output electrical signal is input to the controller 80. Also, if the output signal is a hydraulic signal, the output hydraulic signal is detected by a pressure sensor (not shown.) and the detection result of the pressure sensor is input to the controller 80.

Controller 80

The controller 80 is consisted of a computer having processing and storage devices. The controller 80 performs circuit control based on the signals output from each of the operators 76, 78, 82, 84, 86.

Operation of Hydraulic Circuit 2

Next, the operation of the hydraulic circuit 2 as described above will be described. Hereinafter, the first and second travel switch valves 32, 34 and the actuator switch valve are described as being electromagnetically proportional and controlled by electrical signals from the controller 80.

When the Operators are not Operated

Initially, the case where none of the respective operators 76, 78, 82, 84, 86 have been operated will be described.

When the operators 76, 78, 82, 84, and 86 are not operated, no signal is output from each of the operators 76, 78, 82, 84, and 86 to the controller 80. In this case, the controller 80 positions each switch valve 32, 34, 48, 50, 52 in the closed positions and blocks the line connecting the first and second pump lines 38, 40 and each of the hydraulic actuators 14, 22, 24, 26 by each of the switch valves 32, 34, 48, 50, 52. Therefore, hydraulic oil is not supplied to each of the hydraulic actuators 14, 22, 24, 26, and each of the hydraulic actuators 14, 22, 24, 26 does not operate.

In addition, in the above case, the controller 80 adjusts opening degrees of the first and second bypass valves 66, 68 to a predetermined opening degree of non-full closure. This causes the hydraulic oil discharged from the first hydraulic pump 28 to be returned to the tank 36 through the first bypass line 72 while the pressure of the first pump line 38 is maintained at predetermined standby pressure (e.g., 3-4 MPa). Similarly, the hydraulic oil discharged from the second hydraulic pump 30 is returned to the tank 36 through the second bypass line 74, while the pressure of the second pump line 40 is maintained at predetermined standby pressure (e.g., 3-4 MPa). Note that the boom flow control valve 56, the arm flow control valve 58, and the communication valve 64 are positioned in the closed positions.

When the First and Second Travel Operators 76, 78 are Operated

Next, the case where both the first and second travel operators 76, 78 are operated and the actuator operators (boom operator 82, arm operator 84, bucket operator 86) are not operated will now be described with reference to FIG. 4.

When the first and second travel operators 76, 78 are operated, signals are output from the first and second travel operators 76, 78 according to the operation amount. In this case, the controller 80 opens the first and second travel valves 32, 34 and at the same time, adjusts the opening degrees of the first and second travel valves 32, 34 in accordance with the signals output from the first and second travel operators 76, 78.

The controller 80 also adjusts the pilot pressure acting on the spring chambers of the first and second open-close valves 44, 46 by controlling the electromagnetic proportional valves (not shown). Specifically, by communicating the spring chamber of the first open-close valve 44 with the tank 36, drain pressure is applied to the spring chamber of the first open-close valve 44 to open the first open-close valve 44. On the other hand, the pressure of the first pump line 38 or the second pump line 40, whichever is higher, is acted on the spring chamber of the second open-close valve 46 to close the second open-close valve 46.

In addition, the controller 80 increases the discharge amount of the first and second hydraulic pumps 28, 30 according to the signals output from the first and second travel operators 76, 78 and reduces the opening degrees of the first and second bypass valves 66, 68 to be less than the above predetermined opening degree. This increases the pressure of the first and second pump lines 38, 40 to the required pressure (pressure higher than the above standby pressure).

Figure 4:
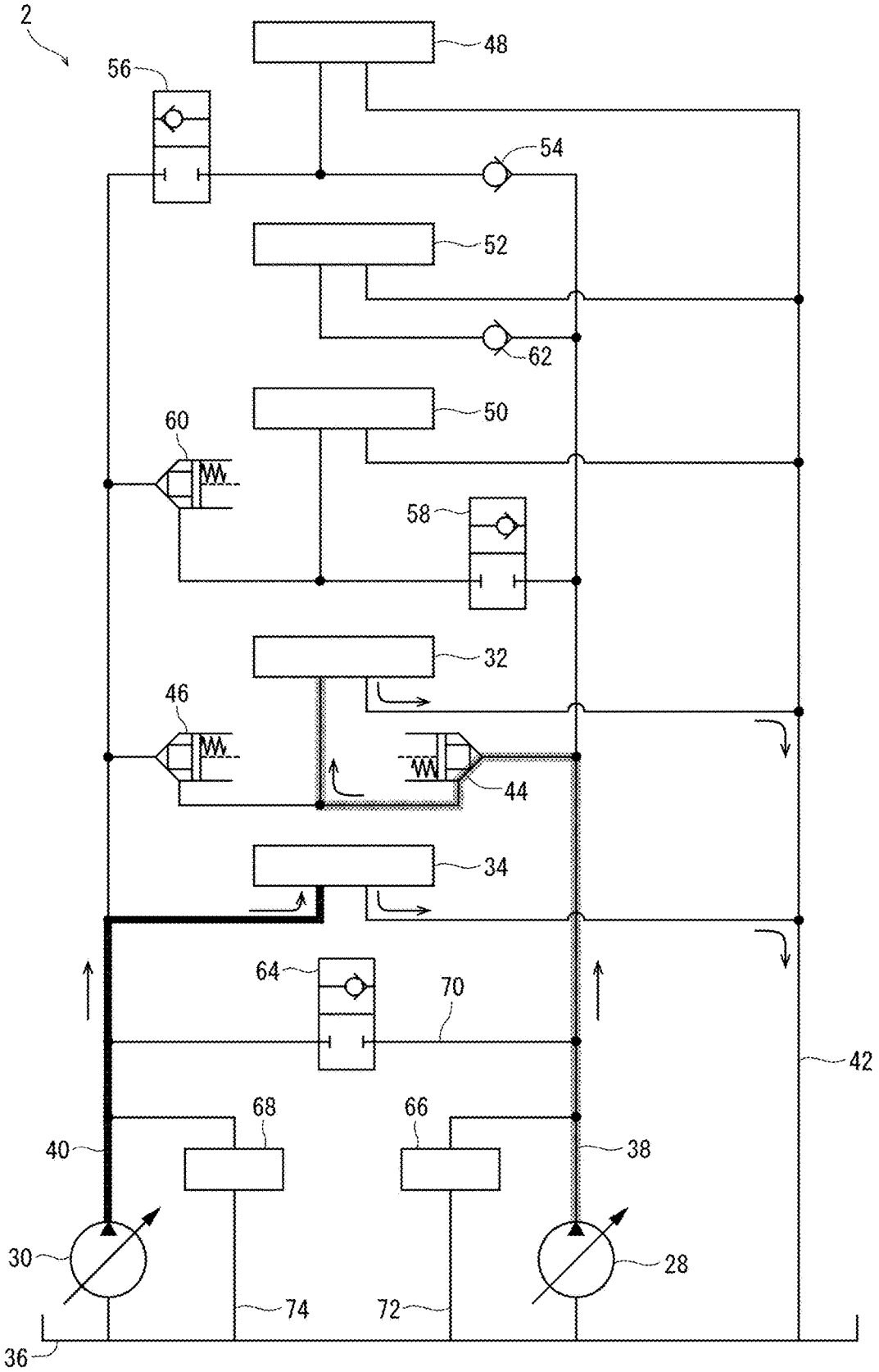
FIG. 4 is a circuit diagram illustrating a flow of hydraulic oil when signals are output from a first travel operator and a second travel operator and a signal is not output from an actuator operator.

Controlled by the controller 80 as described above, the first travel switch valve 32 is supplied with hydraulic oil discharged from the first hydraulic pump 28 via the first open-close valve 44, as shown by the gray bold line in FIG. 4. Then, the hydraulic oil is supplied from the first travel switch valve 32 to the first travel motor 14, and the first travel motor 14 rotates. As mentioned above, the supply amount and discharge amount of the first travel motor 14 are controlled by the first travel switch valve 32.

The second travel switch valve 34 is supplied with hydraulic oil discharged from the second hydraulic pump 30, as shown by bold black line in FIG. 4. Then, the hydraulic oil is supplied from the second travel switch valve 34 to the second travel motor, and the second travel motor rotates. As mentioned above, the supply amount and discharge amount of the second travel motor are controlled by the second travel switch valve 34.

Although both the first and second travel operators 76, 78 have been described here as being operated at the same time, even if one of the first and second travel operators 76, 78 is operated, hydraulic oil flows as shown in FIG. 4. That is, if only the first travel operator 76 is operated, hydraulic oil is supplied from the first hydraulic pump 28 to the first travel switch valve 32. On the other hand, if only the second travel operator 78 is operated, hydraulic oil is supplied from the second hydraulic pump 30 to the second travel switch valve 34.

In the above case, since no signal is output from the actuator operator, the actuator switch valves (the boom switch valve 48, the arm switch valve 50, and the bucket switch valve 52) remain positioned in the closed position. Also, as shown in FIG. 4, the boom flow control valve 56, the arm flow control valve 58, and the communication valve 64 are also maintained in a closed position.

When the Actuator Operators are Operated

Next, with reference to FIG. 5, the case where the actuator operators (the boom operator 82, the arm operator 84, and the bucket operator 86) is operated and both the first and second travel operators 76, 78 are not operated will be described.

When the three of the boom operator 82, the arm operator 84, and the bucket operator 86 are operated simultaneously, a signal is output from each of the operators 82, 84, 86 depending on the operation amount of each of the operators 82, 84, 86. In this case, the controller 80 opens the boom switch valve 48, the arm switch valve 50, the bucket switch valve 52, the boom flow control valve 56, and the arm flow control valve 58, and adjusts the opening degree of each of the switch valves 48, 50, 52 and each of the flow control valves 56, 58 depending on the signals output from each of the operators 82, 84, 86.

In addition, the controller 80 checks the arm poppet valve 60. Specifically, by controlling the electromagnetic proportional valve (not shown), the downstream pressure of the arm poppet valve 60 is acted on the spring chamber of the arm poppet valve 60. This places the arm poppet valve 60 in a checked state. That is, a flow from the second hydraulic pump 30 to the arm switch valve 50 is allowed, but a backflow from the arm switch valve 50 to the second hydraulic pump 30 is prevented.

Further, the controller 80 increases the discharge amount of the first and second hydraulic pumps 28, 30 and reduces the opening degrees of the first and second bypass valves 66, 68 to be less than the predetermined opening above according to the signals output from the boom operator 82, the arm operator 84, and the bucket operator 86. This increases the pressure of the first and second pump lines 38, 40 to the required pressure (pressure higher than the above standby pressure).

Figure 5:
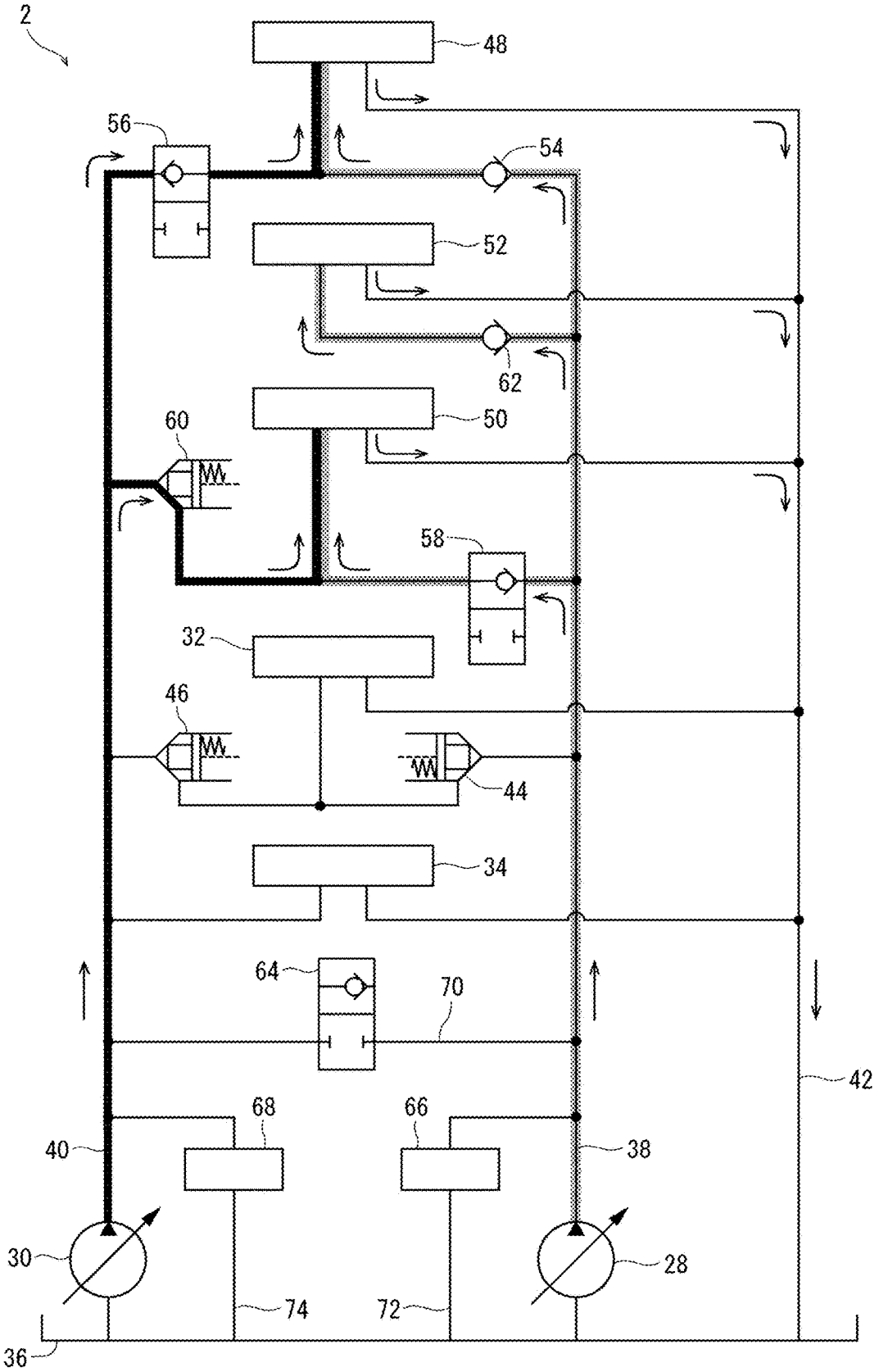
FIG. 5 is a circuit diagram illustrating a flow of hydraulic oil when a signal is output from an actuator operator and no signal is output from a first travel operator and a second travel operator.

Controlled by the controller 80 as described above, the boom switch valve 48 is supplied with hydraulic oil discharged from the first hydraulic pump 28 via the boom check valve 54, as shown by the gray bold line in FIG. 5. Further, the boom switch valve 48 is supplied with hydraulic oil discharged from the second hydraulic pump 30 via the boom flow control valve 56, as shown by the black bold line in FIG. 5. Then, hydraulic oil is supplied from the boom switch valve 48 to the boom cylinder 22, and the boom cylinder 22 actuates. As mentioned above, the supply amount and discharge amount of the boom cylinder 22 are controlled by the boom switch valve 48.

The arm switch valve 50 is supplied with hydraulic oil discharged from the first hydraulic pump 28 via the arm flow control valve 58, as shown by the gray bold line in FIG. 5. Further, the arm switch valve 50 is supplied with hydraulic oil discharged from the second hydraulic pump 30 via the arm poppet valve 60, as shown by black bold line in FIG. 5. Then, hydraulic oil is supplied from the arm switch valve 50 to the arm cylinder 24, and the arm cylinder 24 actuates. As mentioned above, the supply amount and the discharge amount of the arm cylinder 24 are controlled by the arm switch valve 50.

The bucket switch valve 52 is supplied with hydraulic oil discharged from the first hydraulic pump 28 via the bucket check valve 62, as shown by the gray bold line in FIG. 5. Then, hydraulic oil is supplied from the bucket switch valve 52 to the bucket cylinder 26, and the bucket cylinder 26 actuates. As mentioned above, the supply amount and the discharge amount of the bucket cylinder 26 are controlled by the bucket switch valve 52.

Here, although the case that the three of the boom operator 82, the arm operator 84, and the bucket operator 86 are simultaneously operated has been described, if at least one of the boom operator 82, the arm operator 84, and the bucket operator 86 is operated, the flow of hydraulic oil as shown in FIG. 5 will also occur. That is, the boom switch valve 48 and the arm switch valve 50 are supplied with hydraulic oil from the first and second hydraulic pumps 28, 30, and the bucket switch valve 52 is supplied with hydraulic oil from the first hydraulic pump 28.

In the above case, since no signal is output from the first and second travel operators 76, 78, the first and second travel switch valves 32, 34 remain positioned in the closed position. Also, as shown in FIG. 5, a state in which the communication valve 64 is positioned in the closed position is maintained.

When the First and Second Travel Operators 76, 78 and the Actuator Operator are Operated The case that the first and second travel operators 76, 78 and the actuator operator are simultaneously operated will now be described with reference to FIG. 6. It should be noted that for the first and second travel operators 76, 78, it is assumed that the operation was performed with the same amount of operation (that is, the operation of the straight travel of the lower travel body 6).

If all of the first and second travel operators 76, 78, the boom operator 82, the arm operator 84, and the bucket operator 86 are simultaneously operated, a signal is output from each of the operators 76, 78, 82, 84, 86 depending on the operation amount of each operator 76, 78, 82, 84, 86. In this case, the controller 80 opens the first and second travel switch valves 32, 34, the boom switch valve 48, the arm switch valve 50, and the bucket switch valve 52, and adjusts the opening degree of each switch valve 32, 34, 48, 50, 52 depending on the signals output from each operator 76, 78, 82, 84, 86.

The controller 80 also puts the first open-close valve 44 in the closed state while putting the second open-close valve 46 in the open state. That is, the spring chamber of the first open-close valve 44 is acted on by the pressure of the first pump line 38 or the second pump line 40, whichever is higher, to close the first open-close valve 44. On the other hand, a drain pressure is applied to the spring chamber of the second open-close valve 46 to open the second open-close valve 46.

Further, the controller 80 closes the boom flow control valve 56, opens the arm flow control valve 58 and adjusts the opening degree of the arm flow control valve 58. The arm poppet valve 60 is placed in the closed state in the same manner as the first open-close valve 44.

In addition, the controller 80 increases the discharge amount of the first and second hydraulic pumps 28, 30 depending on the signals output from each of the operators 76, 78, 82, 84, 86 and makes the opening degrees of the first and second bypass valves 66, 68 smaller than the predetermined opening above. This increases the pressure of the first and second pump lines 38, 40 to the required pressure (pressure higher than the above standby pressure).

Figure 6:
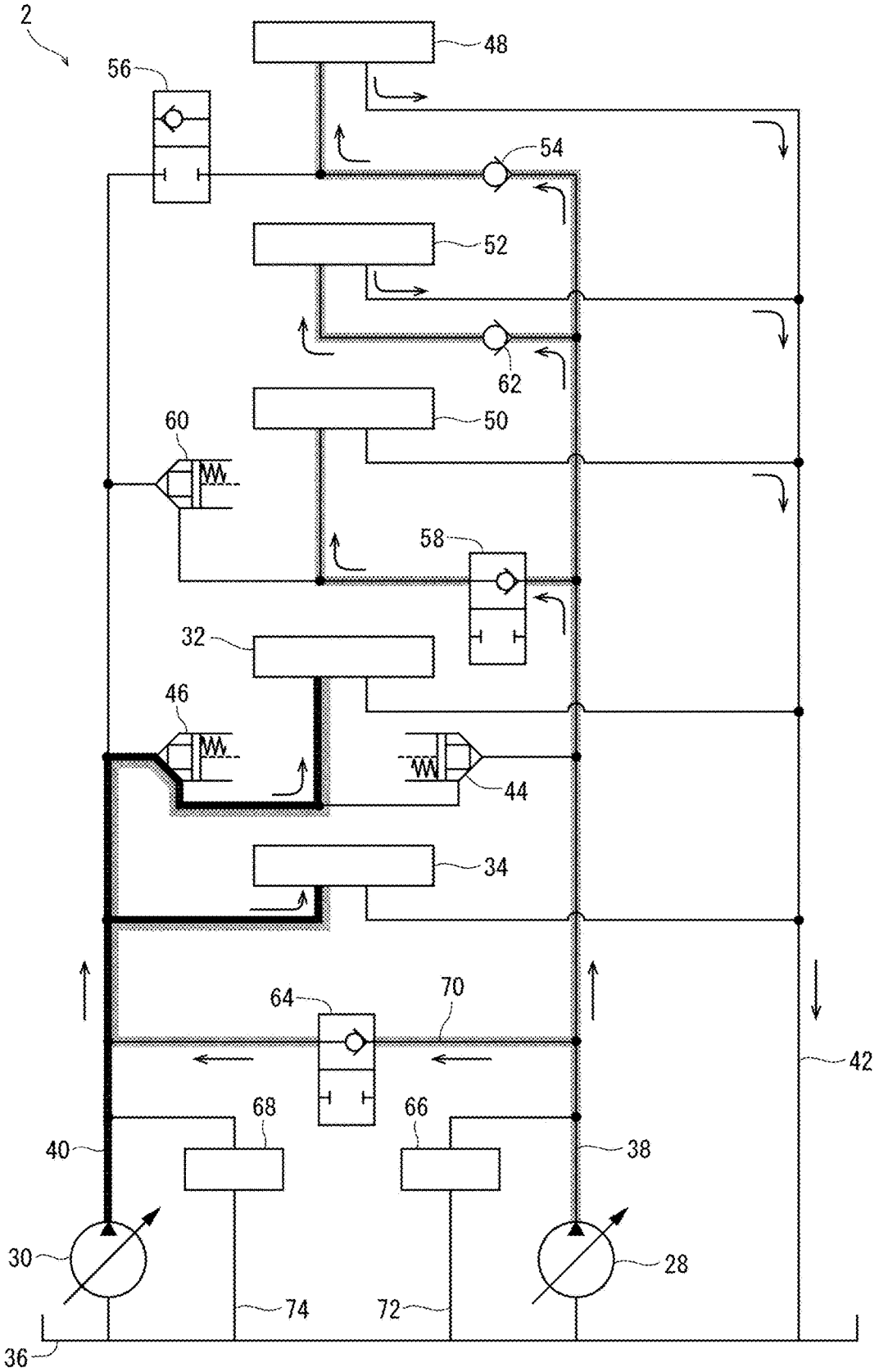
FIG. 6 is a circuit diagram illustrating a flow of hydraulic oil when signals are output from the first and second travel operators and the actuator operator.

Controlled by the controller 80 as described above, the first and second travel switch valves 32, 34 are dispensed and supplied with the same amount of hydraulic oil from the second hydraulic pump 30, as shown by the black bold line in FIG. 6. The same amount of hydraulic oil is then supplied from the first travel switch valve 32 to the first travel motor 14 and from the second travel switch valve 34 to the second travel motor. Thus, straight travel of the lower travel body 6 is ensured because the first travel motor 14 and the second travel motor operate at the same rotational speed.

On the other hand, the boom switch valve 48, the arm switch valve 50, and the bucket switch valve 52 are supplied with hydraulic oil from the first hydraulic pump 28, as shown in FIG. 6 by the grey bold line. That is, in the above case, hydraulic oil is supplied to the actuator switch valve from only the first hydraulic pump 28. Then, the hydraulic oil is supplied from the boom switch valve 48 to the boom cylinder 22, the hydraulic oil is supplied from the arm switch valve 50 to the arm cylinder 24, and the hydraulic oil is supplied from the bucket switch valve 52 to the bucket cylinder 26. As a result, the required work is performed by the front work machine 10 by actuating the boom cylinder 22, the arm cylinder 24, and the bucket cylinder 26.

If such an operation (the operation of the straight travel of the lower travel body 6 and the operation of the front work machine 10) is performed at the same time, the operating speed of the front work machine 10 may cause a surplus in the supply flow rate of the first hydraulic pump 28.

The case where the surplus occurs in the supply flow rate of the first hydraulic pump 28 is a case where the flow rate required by the front work machine 10 is relatively small. That is, it is a case that the required speed for the front work machine 10 is small. In this case, the operation amount of the actuator operator is small, so the signal output from the actuator operator is small.

On the other hand, the case where there is no surplus in the supply flow rate of the first hydraulic pump 28 is case where the flow rate required by the front work machine 10 is relatively high. That is, it is a case that the required speed for the front work machine 10 is large. In this case, because the operation amount of the actuator operator is large, the signal output from the actuator operator becomes large.

Therefore, when signals are output from the first and second travel operators 76, 78 and the actuator operator (when the straight travel operation of the lower travel body 6 and the operation of the front work machine 10 are performed), the controller 80 adjusts the opening degree of the communication valve 64 in accordance with the signal output from the actuator operator to control the supply amount of the hydraulic oil sent from the first pump line 38 to the second pump line 40.

As a result, the excess flow rate of the first hydraulic pump 28 is distributed to the first and second travel switch valves 32, 34 in equal amounts, as shown by the gray bold line in FIG. 6. The excess flow rate of the first hydraulic pump 28, along with the hydraulic oil discharged from the second hydraulic pump 30, is then supplied from the first travel switch valve 32 to the first travel motor 14 and supplied from the second travel switch valve 34 to the second travel motor. As a result, the excess flow of the first hydraulic pump 28 is used to actuate the first travel motor 12 and the second travel motor. Thus, according to the present embodiment, the excess flow rate of the first hydraulic pump 28 may be used effectively.

In a preferred embodiment, when signals are output from the first and second travel operators 76, 78 and the actuator operator, the controller 80 sets an opening degree of the communication valve 64 when the signal output from the actuator operator is less than a predetermined value to be a first opening degree, and sets an opening degree when the signal output from the actuator operator is greater than or equal to the predetermined value to a second opening degree.

For the above "signal output from the actuator operator", for example, the sum of the signal strengths output from each of the boom operator 82, the arm operator 84, and the bucket operator 86 can be obtained. Also, the "signal output from the actuator operator" may be a value of signal strength of any one of the boom operator 82, the arm operator 84, and the bucket operator 86, or may be a sum of the signal strengths of any two of the boom operator 82, the arm operator 84, and the bucket operator 86.

For the "first opening degree" described above, it is desirable to be set to an opening degree to the extent that the rotational speed of the first travel motor 12 is not lower than the required speed according to the operation amount of the first travel operator 76, and that the rotational speed of the second travel motor is not lower than the required speed according to the operation amount of the second travel operator 78. If the first opening degree is too small, the pressure loss in the communication line 70 will be high, and thus the pressure of the hydraulic oil discharged from the first hydraulic pump 28 will be high. This increases the absorption torque of the first hydraulic pump 28. By the way, in a construction machinery such as hydraulic excavators, horsepower control is generally carried out so that the maximum horsepower of the driving source is not exceeded by the pump absorption horsepower. Such horsepower control may cause the absorption torque of the second hydraulic pump 30 to decrease as the absorption torque of the first hydraulic pump 28 rises. In such a case, since the discharge amount of the second hydraulic pump 30 is reduced, the rotational speed of the first travel motor 14 and the rotational speed of the second travel motor may be lower than the required speed. Accordingly, it is desirable that the first opening degree is set to an opening degree (not too small opening degree) to the extent that the rotational speed of the first travel motor 12 is not less than the required speed according to the operating amount of the first travel operator 76 and the rotational speed of the second travel motor is not less than the required speed according to the operation amount of the second travel operator 78.

The first opening degree may be changed depending on a signal of the actuator operator. For example, in a case where the signal of the actuator operator is less than a predetermined value, the first opening degree may be increased as the signal of the actuator operator is smaller, and the first opening degree may be decreased as the signal of the actuator operator is larger. This allows an appropriate flow rate to be supplied from the first pump line 38 to the second pump line 40 in accordance with the excess flow rate generated.

For the above "second opening degree", it is preferable to be set to an opening degree to the extent that the actuation speed of the other hydraulic actuators (the boom cylinder 22, the arm cylinder 24, and the bucket cylinder 26) is not lower than the required speed according to the operation amount of the actuator operators (the boom operator 82, the arm operator 84, and the bucket operator 86). If the required speed of the front work machine 10 is high, the pressure of the first pump line 38 is generally higher than the pressure of the second pump line 40. Therefore, if the second opening degree is too large, the hydraulic oil escapes from the first pump line 38 to the second pump line 40, and the necessary flow rate cannot be supplied to the boom cylinder 22, the arm cylinder 24, and the bucket cylinder 26. Accordingly, the second opening degree is preferably set to an opening degree (not too large opening degree) to the extent that the actuation speed of the other hydraulic actuator is not less than the required speed depending on the operation amount of the actuator operator.

The second opening degree may be changed depending on a signal of the actuator operator. For example, when the signal of the actuator operator is equal to or greater than a predetermined value, the second opening degree may be increased as the signal of the actuator operator is smaller, and the second opening degree may be decreased as the signal of the actuator operation tool is larger. Accordingly, this further prevents the hydraulic oil from escaping from the first pump line 38 to the second pump line 40 and being unable to supply the necessary flow rate to the boom cylinder 22 or the like. Further, the second opening degree may be fully closed.

Also, when the controller 80 sets the opening degree of the communication valve 64 to the first opening degree, it is advantageous to reduce the discharge amount of the second hydraulic pump 30 to the extent that the rotational speed of the first travel motor 14 is not lower than the required speed according to the operation amount of the first travel operator 76 and the rotational speed of the second travel motor is not lower than the required speed according to the operation amount of the second travel operator 78. Accordingly, this can reduce energy consumption (fuel consumption if the driving source of the first and second hydraulic pumps 28, 30 is an engine, and power consumption if the driving source of the first and second hydraulic pumps 28, 30 is an electric motor).

Although the case where the operators 76, 78, 82, 84, and 86 are simultaneously operated has been described here, even when any one of the actuator operators is operated together with both of the first and second travel operators 76 and 78, the flow of hydraulic oil is as shown in FIG. 6. That is, the first and second travel switch valves 32, 34 may be supplied with hydraulic oil primarily from the second hydraulic pump 30 and with an excess flow rate of the first hydraulic pump 28 depending on a signal output from the actuator operator. Also, the boom switch valve 48, the arm switch valve 50, and the bucket switch valve 52 are supplied with hydraulic oil from only the first hydraulic pump 28.

As described above, in the present embodiment, when the first and second travel operators 76, 78 and the actuator operator are operated simultaneously (when the operation of the straight travel of the lower travel body 6 and the operation of the front work machine 10 are performed simultaneously), the opening degree of the communication valve 64 is adjusted depending on the signal output from the actuator operator to control the supply amount of hydraulic oil sent from the first pump line 38 to the second pump line 40. Thus, with the hydraulic oil discharged from the second hydraulic pump 30, the excess flow of the first hydraulic pump 28 may be effectively used because the excess flow of the first hydraulic pump 28 is supplied to the first travel motor 14 and the second travel motor via the first and second travel switch valves 32, 34.

In the present embodiment, the first and second travel switch valves 32, 34 and the actuator switch valve are described as being electromagnetically proportional and controlled by electrical signals from the controller 80. However, the first and second travel switch valves 32, 34 and the actuator switch valve may be hydraulically piloted. In this case, each of the switch valves 32, 34, 48, 50, and 52 is controlled by hydraulic signals output from each operators 76, 78, 82, 84, 86. Also, the output hydraulic signal is detected by a pressure sensor (not shown.) and the detection result of the pressure sensor is input to the controller 80. The controller 80 can then perform the control described above on the first and second open-close valves 44, 46, etc., based on the detection result of the pressure sensor.

What is claimed is:

1. A hydraulic circuit of a construction machinery for supplying hydraulic oil to a first travel motor, a second travel motor and other hydraulic actuator, the hydraulic circuit comprising:

a first capacity-variable hydraulic pump, a second capacity-variable hydraulic pump, a first pump line in which hydraulic oil discharged from the first hydraulic pump flows, a second pump line in which hydraulic oil discharged from the second hydraulic pump flows, a first travel switch valve connected to the first pump line and the second pump line and configured to switch a flow direction of hydraulic oil relative to the first travel motor, a second travel switch valve connected to the second pump line and configured to switch a flow direction of hydraulic oil relative to the second travel motor, an actuator switch valve connected to at least the first pump line and configured to switch a flow direction of hydraulic oil relative to the other hydraulic actuator;

a first open-close valve provided between the first hydraulic pump and the first travel switch valve, a second open-close valve provided between the second hydraulic pump and the first travel switch valve, a communication line communicating the first pump line and the second pump line, a communication valve provided in the communication line, a first travel operator configured to output a signal for operating the first travel motor, a second travel operator configured to output a signal for operating the second travel motor, an actuator operator configured to output a signal for operating the other hydraulic actuator, and a controller that performs circuit control based on signals output from the first travel operator, the second travel operator, and the actuator operator, wherein the controller:

opens the first open-close valve and closes the second open-close valve when a signal is output from the first travel operator and/or the second travel operator and no signal is output from the actuator operator, thereby causing the first hydraulic pump to supply hydraulic oil to the first travel switch valve and/or causing the second hydraulic pump to supply hydraulic oil to the second travel switch valve and closing the communication valve; and on the other hand, when signals are output from the first travel operator, the second travel operator, and the actuator operator, causes hydraulic oil to be supplied from the first hydraulic pump to the actuator switch valve, and by closing the first open-close valve and opening the second open-close valve, causes hydraulic oil to be supplied from the second hydraulic pump to the first travel switch valve and the second travel switch valve, and at the same time, adjusts an opening degree of the communication valve in response to the signal output from the actuator operator to control an amount of hydraulic oil supplied from the first pump line to the second pump line.

2. The hydraulic circuit of a construction machinery according to claim 1, wherein the controller, when signals are output from the first travel operator, the second travel operator and the actuator operator, sets an opening degree of the communication valve to be a first opening degree when the signal output from the actuator operator is less than a predetermined value, and a second opening degree that is less than the first opening degree when the signal output from the actuator operator is greater than or equal to the predetermined value.

3. The hydraulic circuit of a construction machinery of claim 2, wherein the first opening degree is set to an opening degree such that a rotational speed of the first travel motor is not less than a required speed according to an operation amount of the first travel operator and a rotational speed of the second travel motor is not less than a required speed according to an operation amount of the second travel operator.

4. The hydraulic circuit of a construction machinery of claim 2, wherein the first opening degree is changed depending on the signal of the actuator operator.

5. The hydraulic circuit of a construction machinery of claim 2, wherein the second opening degree is set to an opening degree such that an operating speed of the other hydraulic actuator is not less than a required speed depending on an operation amount of the actuator operator.

6. The hydraulic circuit of a construction machinery of claim 2, wherein the second opening is changed depending on the signal of the actuator operator.

7. The hydraulic circuit of a construction machinery of claim 2, wherein the second opening degree is fully closed.

8. The hydraulic circuit of a construction machinery of claim 2, wherein when the controller sets the opening degree of the communication valve to the first opening degree, a discharge amount of the second hydraulic pump is reduced to an extent that the rotational speed of the first travel motor is not lower than a required speed depending on an operation amount of the first travel operator, and the rotational speed of the second travel motor is not lower than a required speed depending on an operation amount of the second travel operator.

9. The hydraulic circuit of a construction machinery of claim 1, wherein the communication valve has a backflow prevention function that allows a flow of hydraulic oil from the first pump line to the second pump line but prevents a backflow from the second pump line to the first pump line.

10. The hydraulic circuit of a construction machinery of claim 1, wherein the actuator switch valve is connected to both the first pump line and the second pump line;

a check valve is provided between the actuator switch valve and the first hydraulic pump, and a flow control valve is provided between the actuator switch valve and the second hydraulic pump.

11. The hydraulic circuit of a construction machinery of claim 1, wherein the actuator switch valve is connected to both the first pump line and the second pump line;

a flow control valve is provided between the actuator switch valve and the first hydraulic pump, and a poppet valve is provided between the actuator switch valve and the second hydraulic pump.

12. The hydraulic circuit of a construction machinery of claim 1, wherein the actuator switch valve is connected to the first pump line, but not connected to the second hydraulic pump line, and a check valve is provided between the actuator switch valve and the first hydraulic pump.

* * * * *